United States Patent [19]

Weed

[11] 4,151,995

[45] May 1, 1979

[54] TENNIS RACKET WITH PLAYABLE THROAT AREA

[76] Inventor: Thurlow Weed, 1765 Edgemont Rd., Columbus, Ohio 43212

[21] Appl. No.: 679,745

[22] Filed: Apr. 23, 1976

[51] Int. Cl.[2] ..... A63B 49/02

[52] U.S. Cl. ..... 273/73 C; 273/73 G

[58] Field of Search ..... 273/73 R, 73 C, 73 D, 273/73 F, 73 G, 73 H, 29 A, 67 R

[56] References Cited

U.S. PATENT DOCUMENTS 3,305,235 2/1967 Williams ..... 273/169 X 3,999,756 12/1976 Head ..... 273/73 C

FOREIGN PATENT DOCUMENTS 178843 6/1954 Austria ..... 273/73 C 1495578 8/1967 France ..... 273/73 C

*Primary Examiner*—Richard J. Apley

[57] ABSTRACT

A tennis racket having the head frame so constructed that it is wider and longer than the width and length respectively of the head frame of a conventional tennis racket so as to define a strung area which includes what would normally be the unplayable throat area of a conventional tennis racket.

1 Claim, 2 Drawing Figures

TENNIS RACKET WITH PLAYABLE THROAT AREA

An object of this invention is to prevent the unpredictable and uncontrollable rebound characteristics produced in tennis balls striking the throat area of conventional rackets. This invention replaces these unplayable irregularly shaped solid surfaces with a playable strung section that allows playability and control of balls struck there. Shape of the frame creates the new strung area into which the strings are extended from the conventional head area, also achieving the object and benefits of greater individual string length.

Figure 1:
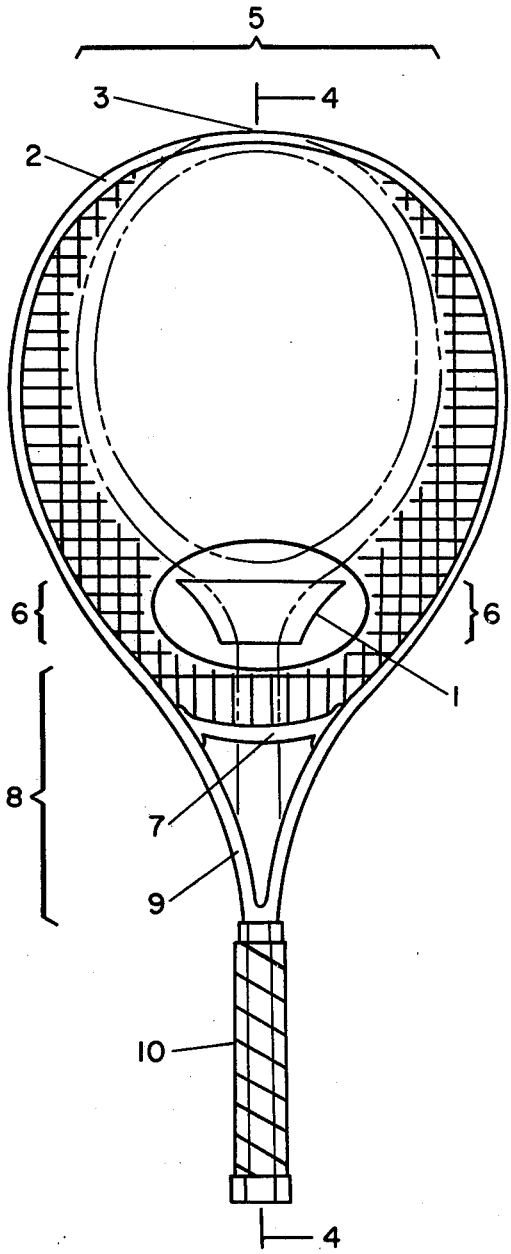

In the drawings FIG. 1 is a front view of the racket forming this invention, coincident at the tip of the head with a phantom line drawing of a model representative of all prior art rackets insofar as it concerns the features discussed in this patent application, for illustrative purposes.

Figure 2:
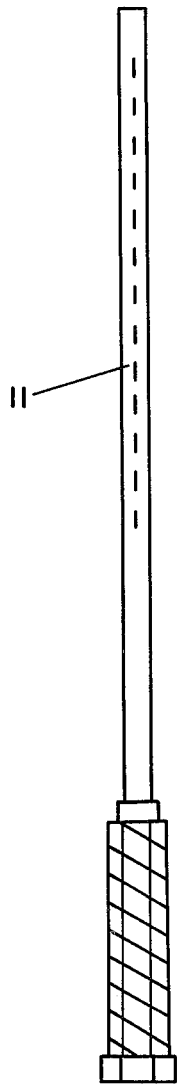

FIG. 2 is a side view of the invention.

In the preferred embodiment of the invention the throat area, or portion between the sides of the frame of prior existing tennis rackets consisting of the handleward end of the stringing frame and its yoke members commences closer than thirteen inches from the tip of the head measured along the centerline, and extends up to three more inches before the racket shaft and shaft bracing components are encountered. The solid materials with uneven surfaces which produce unplayable rebound characteristics in prior art rackets in the throat area 1 thereof are replaced in the invention by a playable strung section encompassed by a frame 2, usually of extruded aluminum that is always shaped in such a way as to position it outside the throat area 1 that is defined by location of the throat components in the prior art rackets. All prior art rackets have unplayable throat components at points between the frame sides from 13 to 16 inches along the centerline 4 as measured from the tip 3 of the head. The shape of the frame of this invention required to encompass the normal prior art throat area 1 is characterized by a separation of the sides of the frame 2 beyond the head width 5 of the prior art rackets and a length of the sides of the frame 2 greater than the length of the sides of the prior art rackets so that these sides of frame 2 are well outside the normal prior art throat area 1 in the zone 6 and do not converge to form the newly positioned throat 7 of the inventor's racket in the zone 8 until one-half to three-quarters of the overall racket length measured from the tip of the head. The point of convergence of the sides of the frame into the handle shaft 9 occurs immediately adjacent to the handle grip 10. The thickness of the frame perpendicular to the plane of the frame is of standard thickness 11. Standard materials and design techniques are used to control weight and strength characteristics.

What is claimed is:

1. A tennis racket comprising a frame forming a head and connected to a handle shaft through a throat section; said head encompassing an oval-shaped strung area which has a length within the range of greater than 15 inches to 21 inches as measured from the tip of said head along the center line of said racket, has a width substantially greater than the 9 inch width of the strung area of a conventional tennis racket, said width being less than said length of said strung area, the overall length of said tennis racket being from 26 to 28 inches, and wherein said frame sides converge so as to form said throat section at the end of said strung area adjacent said handle shaft and join said handle shaft immediately adjacent said handle grip.

* * * * *